United States Patent [19]

Stadler

[11] Patent Number: 4,876,482

[45] Date of Patent: Oct. 24, 1989

[54] HALOGEN CYCLE INCANDESCENT LAMP STRUCTURE

[75] Inventor: Karl Stadler, Adelsschlag-Ochsenfeld, Fed. Rep. of Germany

[73] Assignee: Patent-Treuhand-Gesellschaft für elektrische Glühlampen, Munich, Fed. Rep. of Germany

[21] Appl. No.: 272,214

[22] Filed: Nov. 14, 1988

[30] Foreign Application Priority Data

Dec. 21, 1987 [DE] Fed. Rep. of Germany ..... 8716797

[51] Int. Cl.[4] ..... H01K 1/18

[52] U.S. Cl. ..... 313/579; 313/271

[58] Field of Search ..... 313/578, 579, 580, 271, 313/274, 283, 284, 285

[56] References Cited

U.S. PATENT DOCUMENTS

| | | | |
|---|---|---|---|
| 3,497,753 | 10/1967 | Huston, Jr. | 313/285 |
| 3,696,265 | 10/1972 | Martin et al. | 313/579 |
| 3,899,505 | 8/1975 | Danko | 313/271 |

*Primary Examiner*—Donald J. Yusko
*Assistant Examiner*—Sandra L. O'Shea
*Attorney, Agent, or Firm*—Frishauf, Holtz, Goodman & Woodward

[57] ABSTRACT

To provide a mount for a halogen incandescent lamp, extending longitudinally within an elongated, for example essentially cylindrical bulb (2), the filament, preferably, is a coiled-coil filament and the mount includes a first lead-in conductor (8) which extends inwardly of the bulb and, adjacent the remote end of the bulb, is bent over in inverted V or arch shape, towards the lamp axis, and then downwardly to define an essentially arch or roof shaped construction, the second leg (15) of the bent filament being bent inwardly 180° towards the lamp axis, and then downwardly towards the near end, with respect to the base, of the lamp bulb, for retention of the remote end of the filament. All legs and bent portions of the longitudinal conductor are located in a common plane, the essentially V or arch-shaped bent-over region approximately spanning the inner diameter of the bulb, but being clear of the inner walls thereof. By locating all the elements in a single plane, the construction is simplified and localized thermal stresses by contact of the lead-in wires or elements close to the hot filament against the quartz glass are avoided.

11 Claims, 2 Drawing Sheets

HALOGEN CYCLE INCANDESCENT LAMP STRUCTURE

Reference to related application, assigned to the assignee of the present invention, the disclosure of which is hereby incorporated by reference: U.S. Ser. No. 07/024,708, filed Mar. 11, 1987, KLAM et al now U.S. Pat. No. 4,812,710.

Reference to related patent, the disclosure of which is hereby incorporated by reference:

U.S. Pat. No. 3,898,505, Danko.

U.S. Pat. No. 3,497,753 to which German Utility Model Publication DE-GM No. 68 04 136 corresponds.

The present invention relates to a halogen incandescent lamp structure, and more particularly to the structural arrangement to retain a coiled-coil or double-coiled filament in position along the longitudinal axis of an elongated, essentially cylindrical bulb. Such halogen incandescent lamps are particularly suitable for a wide range of voltages, for example from between about 50 to 250 V, with a wide range of power, of from between about 40 to 150 W, for example.

BACKGROUND

Halogen incandescent lamps, and particularly the lamps to which the present invention relates and which utilize an essentially cylindrical lamp bulb, may have a filament which extends essentially axially along the lamp. In the specification herein, reference will be made to two longitudinal portions or zones of the lamp, one which is close or near to the base, and the other which is remote from the base. The terms "near" and "remote" will be used, in context, with respect to the base of the lamp.

Usually, an inner current supply lead extends within the bulb to the remote end of the filament. This may also be referred to as a first current supply lead. The remote end of the bulb may have an exhaust tip, and the current supply lead can be supported in the vicinity or in the exhaust tip, see for example the referenced U.S. Pat. No. 3,497,753. This construction is complex and expensive and also results in a point-like or small area thermal loading of the glass bulb. It is difficult to manufacture such lamps, and particularly threading of the incandescent filament in a mount, and exhausting and flushing of the lamp causes difficulty.

It has been proposed—see U.S. Pat. No. 3,898,505, Danko, to bend the current supply lead at the remote end of the bulb in a circular form which closely engages at the inner wall of the glass bulb in order to ensure axial centering of the incandescent filament. This requires the current supply lead to be bent into the aforementioned circular arrangement, that is, in three dimensions. Three-dimensional bending causes relatively high manufacturing and assembly costs. Adjustment of the current supply lead with respect to the overall filament mount is difficult, particularly if very precise centering of the filament with respect to the lamp axis is required.

THE INVENTION

It is an object to provide a halogen cycle incandescent lamp which has a filament support mount which is simple, can be easily made, and reliably retains the filament in a predetermined position within the lamp, for example axially therein, and which does not result in thermal loading of the glass bulb or in high production costs.

Briefly, the first lead-in conductor, extending longitudinally within the lamp bulb, is, at approximately the level of the remote end of the filament, bent into an essentially inverted V, or roof or arch form, defining a first leg extending upwardly from the longitudinal portion to an apex of the essentially V or arch, and a second leg extending downwardly from the apex; further, a reentrant portion is formed on the conductor, integral with the second leg, and extending towards the lamp axis and having a terminal end which is angled in the direction of the lamp axis. The first and second legs span diametrically across the diameter, but clear of the bulb. The first leg, the second leg, and the reentrant portion, as well as the terminal end, are all located in a common plane.

In a preferred form, the lead-in conductor is bent with a V with a tip, the legs of the V defining an obtuse or a right angle. The reentrant portion, preferably, extends parallel to the second leg, the terminal end being bent downwardly, but offset from the lamp axis by a distance of half the diameter of the secondary coiling of a coiled-coil filament, if such is used. This permits ready attachment of such a filament and all structural elements can be in the single or common plane.

The arrangement has the advantage that point-like thermal loading of the glass bulbs is eliminated. Production is simplified since all elements can be bent in a single plane, and support of the elongated first lead-in within the exhaust tip or at the inner wall of the bulb itself is not required. The placement of the current supply is easily defined and simplified within the mount since, rather than being three-dimensional, it need be bent only in a single plane.

Drawings illustrating the embodiment of the invention:

DETAILED DESCRIPTION

Figure 1:
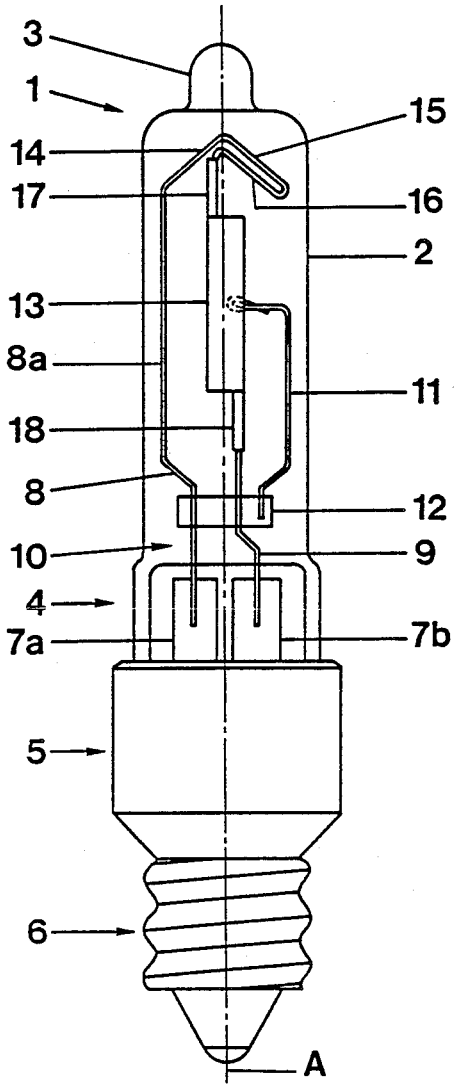
FIG. 1 is a front view of the halogen incandescent lamp in accordance with the invention.
Figure 2:
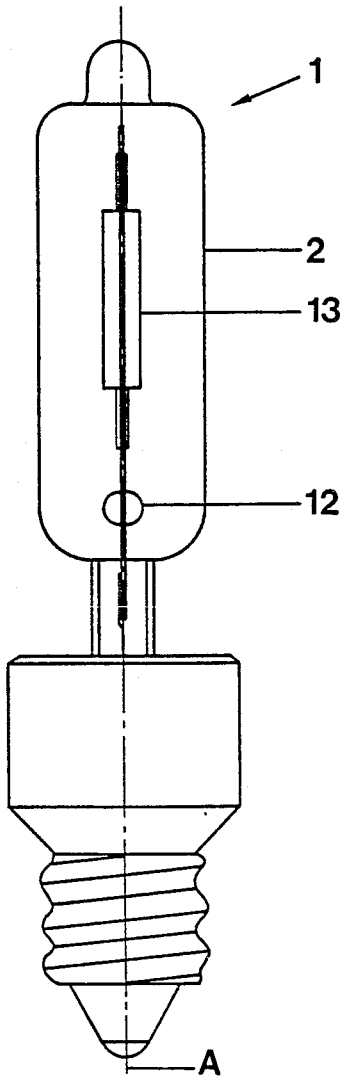
FIG. 2 is a side view of the lamp, that is, a view of FIG. 1 but rotated 90°.

The lamp will be described in connection with a 110 V halogen incandescent lamp of 100 W nominal rating.

Lamp 1 has a cylindrical bulb 2 of quartz glass which is tipped off (reference number 3) at the remote end. The lamp includes a fill of an inert gas with one or more halogen compounds therein. The near end of the bulb 2 is closed off by a pinch or press seal 4 which is secured by means of cement, as well known, in a ceramic base 5. The ceramic base 5 has a metallic or at least partly metallic "Edison" thread 6. The pinch or press seal 4 retains two molybdenum foils or strip *7a, 7b,* which are melted into the pinch or press seal, and which connect two external current supply leads and two inner current supply leads 8, 9. The pinch or press seal, with the foils and conductors therein, provides for a vacuum-tight closure of the bulb 2, while permitting electrical connection. The external electrical connections from the molybdenum foils *7a, 7b* to the tip and to the screw threads 6 are not visible in the drawings and can be of any suitable and standard construction and do not form part of the present invention.

The two inner current supply leads 8, 9 are made of tungsten and form part of a mount 10 which, further, includes a support wire 11. The mount 10 further includes a cross element 12 of quartz glass, which retains the current lead-ins 8, 9 and the support wire 11 in spaced position, as best seen in FIG. 1. The entire mount 10 is located within a single plane.

The lamp has a filament 13 which extends axially within the lamp. The filament is a coiled-coil or double-coiled filament 13, having a center axis congruent with the axis A of the lamp. The coiled-coil filament 13 is held in position by the three components 8, 9, 11 forming part of the mount 10.

The support wire 11, as well known, is melt-connected in the cross element 12 by being melted therein. It extends parallel to the filament 13 up to about the center length thereof, terminating in a loop which helps to retain the filament in position.

The first current supply lead, connected to the molybdenum foil *7a*, extends parallel to the axis A of the lamp from the region beyond the pinch or press seal 4 and is then melt-connected at the end of the cross element 12 remote from the position of the support wire 11. The first current supply lead is then externally angled and then carried parallel to the axis A of the lamp, forming an upwardly extending longitudinal portion 8*a* up to about the level of the remote end of the filament 13. At the remote end, the first lead-in conductor is angled off by about 45° with respect to the axis A of the lamp, to form an inwardly and upwardly extending leg 14. At about the position of the lamp axis A, it is once more bent, in the same place as before, to form a second and free leg 15. The legs 14, 15 extend, thus, in approximately roof shape, in form of a inverted V, spanning almost, but not quite, the entire inner diameter of the bulb 2. The first current supply lead is, thus, a unitary bent structure, see e.g. FIG. 1. The ridge of this "roof", or the apex, is at the axis of the lamp. Neither one of the legs 14, 15 touches the inner wall of the bulb.

The end 16 of the free leg 15 is bent about itself by about 180° to form a reentrant portion 16 which extends up to the vicinity of the lamp axis A. The terminal portion of the free leg is bent downwardly in the direction of the lamp axis, that is, towards the base or the near end of the lamp.

The second lead-in 9 is offset towards the axis of the lamp and then carried through the cross element 12. From cross element 12, lead-in 9 extends longitudinally in a straight line parallel to the axis to the near end of the filament The filament 13 is axially oriented, and has ends 17, 18 which are only singly coiled, and which are, then, both offset by half the diameter or, in other words, by the radius of the secondary coiling with the respect to the lamp axis A. They are pushed over the end of the current supply leads 8, 9, and retained thereon. Additional attachment can be made by hot crimping or by forming a V-shaped holding portion on the current supply leads or by flattening the holding portions and securing the filament to the current supply leads as explained in detail in the referenced application U.S. Ser. No. 07/024,708, filed Mar. 11, 1987, KLAM et al, now U.S. Pat. No. 4,812,710.

Lamps of this type can be constructed for various voltages, and for example for voltages to 220 or 250 V. The lamp can also operate at lower voltages, for example if the network voltage is 120 V, the effective voltage can be decreased by placing a diode in series with one of the lead-in conductors, the diode being located, for example, in the base 5 and integrated therein, leaving about 84 V across the filament.

Various changes and modifications may be made within the scope of the inventive concept.

Figure 3:
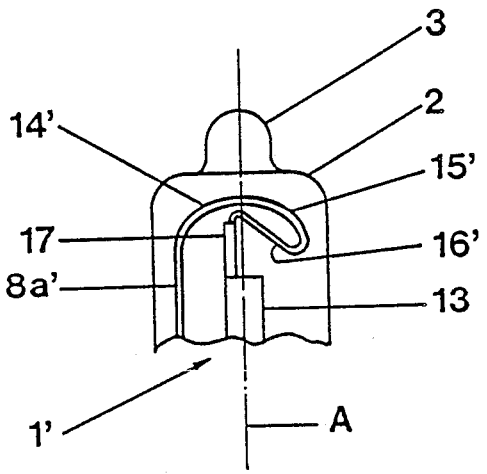
FIG. 3 is a fragmentary front view illustrating a lead-in conductor in modified form.

FIG. 3 illustrates a modification in which the leg portions 14', 15' form part of a round arch.

I claim:

1. A halogen cycle incandescent lamp having
a base (5);
a closed, essentially cylindrical bulb (2) extending from a near end portion close to the base to a remote end portion and defining a lamp axis (A);
an axially extending filament (13) having a near filament end close to the base and a remote filament end;
a filament mount (10) including
first and second lead-in conductors (8, 9), and
a cross element (12) retaining said lead-in conductors in position in the bulb;
the first lead-in conductor (8) extending from the cross element toward the remote end portion of the bulb and having a longitudinal portion (8*a*) extending along an inner wall of the bulb to retain the remote end of the filament;
a pinch or press seal (4) secured in the base and connecting the mount with external current conductors,
and wherein, in accordance with the invention,
the first lead-in conductor (8), at approximately the level of the remote end of the filament, is bent in essentially inverted V or roof or arch form defining a first leg (14) extending upwardly from the longitudinal portion to an apex of the inverted essentially V or arch shape, and a second leg (15) extending downwardly from the apex;
said first lead-in conductor being further formed with a reentrant portion (16) integral with the second leg (15) and extending towards the lamp axis (A) and having a terminal end which is bent in a direction of the axis of the lamp,
said first and second legs spanning diametrically almost across the diameter of the bulb without touching the inner wall of the bulb, and said first and second legs (14, 15) and said reentrant portion (16) and said longitudinal portion (8*a*) all being located in a common plane.

2. The lamp of claim 1, wherein said reentrant portion (16) extends essentially parallel to said second leg (15).

3. The lamp of claim 1, wherein said first lead-in conductor (8) is bent into substantially V shape and defines a tip located at the apex thereof and positioned at the axis (A) of the lamp.

4. The lamp of claim 1, wherein said first and second legs (14, 15) form a right or an obtuse angle.

5. The lamp of claim 1, wherein said lamp axis is positioned in said common plane.

6. The lamp of claim 1, wherein the terminal end (16) of the reentrant portion extends up to at least the vicinity of the lamp axis (A).

7. The lamp of claim 1, wherein the terminal end is bent parallel to the lamp axis in a direction towards the base (5).

8. The lamp of claim 1, further including a support wire (11) secured to the cross element (12) free of electrical potential, and extending up to about a center region of the incandescent filament (13).

9. The lamp of claim 1, wherein the incandescent filament (13) is a coiled-coil or double-coiled filament, the near filament end and the remote filament end, each, being singly coiled, said singly coiled ends of the coiled-coil filament being offset with respect to the axis of the lamp by about the radius of the secondary coiling, the singly coiled ends of said filament being secured to the terminal end portions of said first and secondlead-in conductors, respectively:

and wherein the reentrant portion (16) of the first lead-in conductor (8) is bent parallel to the second leg thereof and its terminal end is bent parallel to the lamp axis but offset from the lamp axis by the radius of the secondary coiling of the filament.

10. The lamp of claim 1, wherein the terminal end of the first lead-in conductor is bent towards the near end of the lamp.

11. The lamp of claim 1, wherein the first lead-in conductor (8) is a unitary element.

* * * * *